United States Patent [19]

Dube

[11] 4,231,202

[45] Nov. 4, 1980

[54] DOUBLE-GLAZED BUILDING PANEL AND FILLING SYSTEM

[76] Inventor: Marcel Dubé, 757 Cecile, Hawkesbury, Ontario, Canada K6A 1P2

[21] Appl. No.: 972,266

[22] Filed: Dec. 22, 1978

[30] Foreign Application Priority Data

Jan. 24, 1978 [CA] Canada ..... 295516

[51] Int. Cl.[3] ..... E04B 2/40; E04C 1/42; E06B 3/66

[52] U.S. Cl. ..... 52/171; 47/17; 52/743; 350/258

[58] Field of Search ..... 52/171, 743; 47/17; 350/258, 266, 267

[56] References Cited

U.S. PATENT DOCUMENTS

| | | | |
|---|---|---|---|
| 3,903,665 | 9/1975 | Harrison | 52/171 |
| 4,147,002 | 4/1979 | Kautz | 52/171 |

FOREIGN PATENT DOCUMENTS

| | | | |
|---|---|---|---|
| 1043070 | 11/1978 | Canada | 52/171 |

*Primary Examiner*—Alfred C. Perham

[57] ABSTRACT

A system for filling double-glazed panels such as large windows and double layered greenhouse walls with preferably granular material for insulation, shading, and/or privacy. This system is characterized by filling the interspace without blowing the conveying gas in the latter thereby avoiding the occurrence of damaging gas pressure in the interspace and allowing the use of relatively thinner glazing sheets of glass, plastic, or the like. This system also allows to sequentially and/or selectively fill any number of panel sections connected to the bottom side of a common header which fills the panel sections by settling of the granular material therein and in the panel sections through apertures in the bottom of the header. The panel sections are sequentially and/or selectively evacuated by an evacuation duct underlying the lower edge portion of the panel sections.

10 Claims, 5 Drawing Figures

DOUBLE-GLAZED BUILDING PANEL AND FILLING SYSTEM

This invention relates to a system for filling double-glazed building panels with preferably insulating light granular material for the purposes of insulating, shading or privacy, and for evacuating the same when light transmission is to be restored.

THE PRIOR ART

Large windows and greenhouses walls are great losers of heat during cold nights and heat traps only too efficient during hot sunny days. In particular with the ever increasing price of fuel it is becoming uneconomical to operate greenhouses in cold countries; on the other hand during hot sunny days large amounts of ventilation are required to reject the heat trapped inside a greenhouse or behind glass walls.

One useful method of partially overcoming these problems is to use double-glazed windows and fill the interspace between the two sheets of glass or the like with light granules when insulating or shading is required and to evacuate such interspace when light transmission is to be restored. One system commercially offered does this by having a pump pressurize a drum containing expanded polystyrene beads. The beads are forced through a tube and discharge through a filling valve at the top of a window section. The air conveying the beads and the air displaced from inside the window escapes through a vent at the top of the window which has a screen to prevent the beads from escaping also. To restore light transmission, a pump creates a vacuum inside the drum drawing the beads from the bottom of the window while air is admitted through the top vent.

Such a system is very simple if only a few windows are to be filled; however, to fill large windows or a great number of windows or the walls of a greenhouse it becomes unpractical, unwieldy and uneconomical because of the large number of individual pipes running to individual window sections, pumps pressurizing or making vacuum in the containers, controls and safety valves to prevent the windows from bursting particularly when filling is nearing completion.

THE INVENTION

The present invention greatly simplifies and renders safe the filling of double-glazed building panels by gas conveying the granular material from a storage container by low pressure blower means and having the gas conveyed granular material flow through a duct-like header of a cross-sectional area sufficiently large to effectively reduce the velocity of the conveying gas low enough that it will no longer sustain the granular material which will then drop to the bottom of the header while the conveying gas returns to the storage container. The header communicates through bottom openings with the interspace in the double-glazed panel or row of such panels underneath the header whereby the granular material drains into the panels which are either vertical or at an angle sufficient to cause the granular material to flow in it. Conventional means such as blowers and ducts can be used for conveying the granular material in large volume with little pressure. A large number of panels can be filled from a common header, the lenght of which is only limited by the power of the blower and the limitation that the pressure drop across the lenght of the header not exceed the pressure bearing capacity of the glazing material.

Similarly the panels are evacuated by allowing the granular material to drain into a flow of conveying gas circulating in a duct running along the bottom of the panels for conveying the granular material back to the storage container, again using conventional means such as a blower and ducts.

The system is safe, simple and economical; since low pressures are involved light glazing, light ducting and conventional low pressure blowers can be used; one large common storage container is used; few controls are required.

Whenever referred to throughout the disclosure and claims the following expressions are such as follows:

"Header" means a conduit through which gas or gas conveyed granular material can flow and which can be either:

(a) a separate conduit with bottom outlet means through which granular material can drain; or (b) a conduit being an integral part of the double-glazed panel as a duct like extension or enlargement of the upper portion of the panel; or (c) a conduit generally consisting of a sequence of sections as defined in (a) and/or sections as defined in (b).

"Granular material" means a material generally consisting of light, free flowing granules which can be gas conveyed, are relatively dust and static free and have insulating and/or opacity properties.

"Panel" means a light-transmitting structure adapted to be part or a portion of the exterior wall of a building, of a partition wall and by extension the walls of a greenhouse, said panel being double-glazed, i.e. having two panes of glass or rigid plastics or two flexible membrances of plastics or combinations thereof, spaced apart and held by at least two structural members.

In the drawings which illustrate embodiments of the invention:

Figure 1:
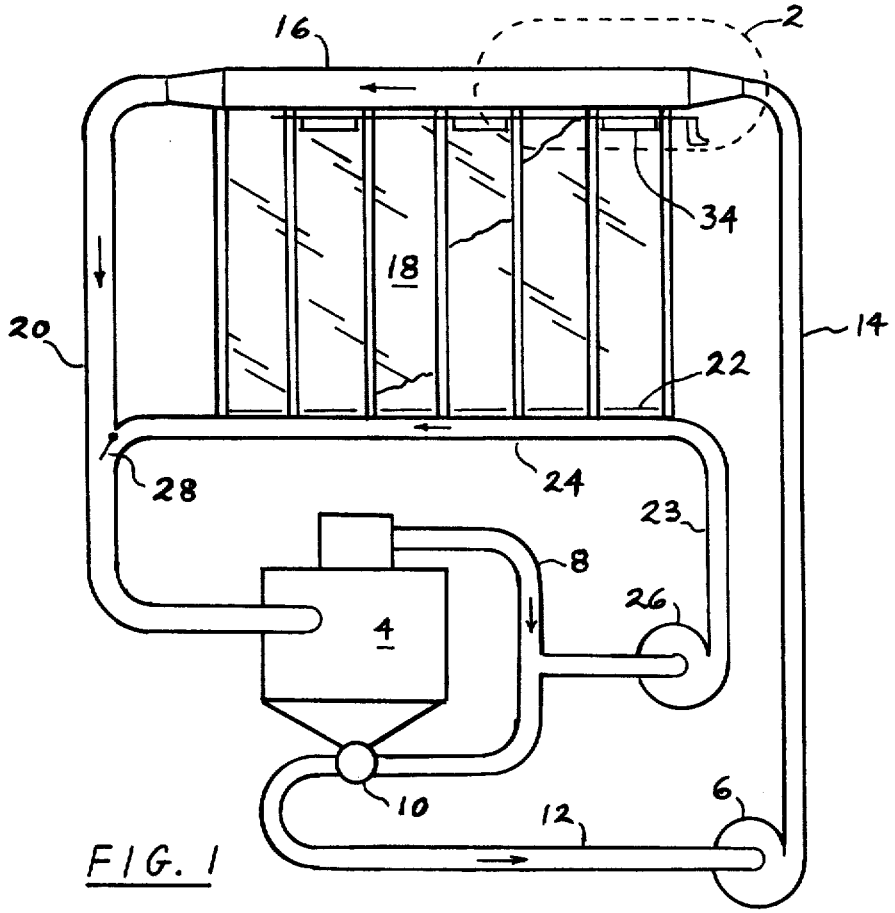
FIG. 1 is a schematic view showing a system for filling and evacuating the panels according to a preferred embodiment of the invention.

Referring now to FIG. 1 the schematic shows a storage container 4 of sufficient capacity to hold enough granular material to fill the double-glazed panel structure 18. Conventional gas conveying means including the mixing valve 10 at the bottom of the container, pipes 8, 12 and 14, and blower 6 fluidize the granular material into a flow of gas and convey the granular material to header 16. Header 16 is a duct-like conduit secured over the upper edge portion of the panel structure 18 and communicating through bottom openings with the interspace in panel structure 18 which is at an angle not less than the angle of repose of the granular material. Header 16 communicates at the inlet end with pipe 14 and at the outlet end with return pipe 20 through which the conveying gas returns to storage container 4.

Figure 2:
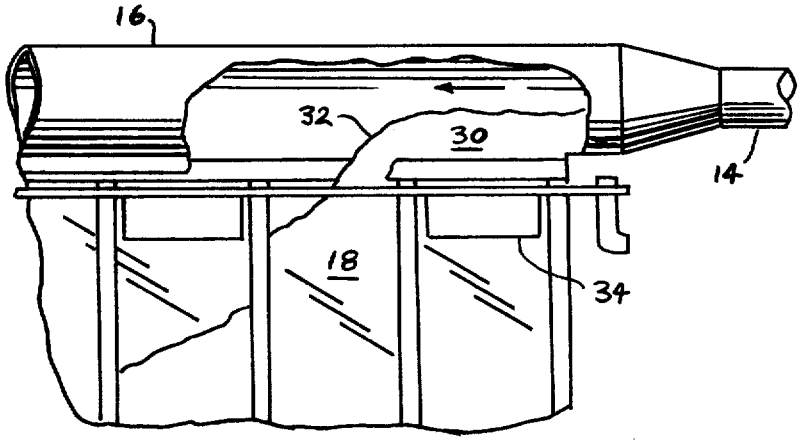
FIG. 2 is an enlarged view of a portion of the header in a preferred embodiment of the invention.

The behaviour of the granular material in header 16 is shown in FIG. 2, as has been experimentally verified. The granular material is conveyed through pipes 12 and 14 at sufficiently high velocity to keep the granular material in a fluidized state. When the cross-sectional area of header 16 is sized relatively close to that of the conveying ducts 12 and 14, some granular material flowing through header 16 can reasonably be expected to fall through the openings in the bottom of header 16 and into panel structure 18; however a large portion of the granular material will not settle and will be conveyed via return pipe 20 back to storage container 4. Given time the panel structure would eventually get filled and this is a less preferred way of the invention.

In a preferred embodiment, header 16 is made sufficiently larger than conveying pipes 12 and 14 for the velocity of the conveying gas to be reduced at or below the settling velocity of the granular material, at which velocity the granular material separates readily from the gas and settles to the bottom of header 16. The settled granular material 30, after filling a portion of the panel structure 18, forms an advancing front 32 which keeps advancing forward as more portions of the panel structure get filled. In this way few granules are conveyed back to storage container except at the very end when the last portion is being filled, and the panel structure is filled in the quickest way. For instances expanded polystyrene beads fluidized into an equal volume of conveying gas can be conveyed at a velocity of 500 ft/min in a 6" diameter pipe resulting in a flow of 100 cu. ft/min; header 16 having a cross-sectional area of 0.5 sq. ft. would cause a reduction in velocity to 200 ft/min at which velocity the beads cannot remain in suspension in the conveying gas and settle. Such a system would fill a double-glazed greenhouse wall for instances 20 ft. wide by 100 ft. long and 2½" thick in 8.33 minutes.

Returning to FIG. 1, in the preferred way of the invention the granular material is evacuated from panel structure 18 by having valve 28 selectively close pipe 20, and sequentially or progressively opening retaining means 22, which may be movable flaps, doors, slides or the like, and allowing the granular material to drain at a controlled rate into evacuation duct 24 through which the conveying gas coming from storage container and moved by blower 26 fluidizes and conveyes the granular material back to storage container 4. In a less preferred way, in which some loads due to vacuum and pressure may result on the glazing sheets of the panels, blower 26 and pipe 23 can be eliminated, the inlet of evacuation duct 24 blocked, valve 28 selectively close pipe 20 and mixing valve 10 selectively retain the granular material in container 4; upon operation of blower 6 and sequentially opening retaining means 22 one at a time, the combined pressure in header 16 and vacuum in evacuation duct would evacuate each portion of panel 18 in sequence. In another less preferred way of the invention, blower 26 and pipe 20, mixing valve 10 retain the granular material in storage container 4 and the inlet of evacuation duct 24 designed in such a way that the granules cannot drain out but outside air may be admitted for conveying, whereby upon operation of blower 6 a vacuum is created in container 4 and outside air is drawn through the inlet of evacuation duct 24 and upon sequentially or progressively opening retaining means 22 the granular material is allowed to drain into the flow of air for conveyance to the storage container 4.

In another embodiment of the invention, partial shading can be accomplished for instances in a greenhouse by selectively closing the top of the interspace in portions of panel structure 18 by closure means 34. Upon operation of blower 6 the unclosed portions of panel structure 18 become filled with granular material while the closed portions remain empty and light transmitting. The unfilled portions would preferably have either their inner or outer or both glazing sheets light diffusing to distribute the incoming light more evenly. To overcome the problem of heat buildup in the granular material when a heat sensitive material like expanded polystyrene is used for shading under intense sun, a cooling gas, normally air, is circulated through the granular material. Although this can be done in numerous ways, in the system shown in FIG. 1 this is done by having valve 28 selectively close the outlet of evacuation duct 24, upon operation of blower 26 cooling air either drawn from container 4 or from the outside through the granular material in the filled portions of panel structure 18 and is finally exhausted outside through a suitable vent not shown. Closure means 34 in this case must effectively seal the unfilled portions in order to force the cooling air through the filled portions. Since the cooling air is forced simultaneously through all the filled portions, the velocity is relatively small through the granular material and the pressure drop through the filled portions is small so that little pressure is exerted on the glazing sheets; for added security the blower may be operated at reduced speed and/or a relief valve used in duct 24 to prevent excessive pressure.

FIG. 1 shows two blowers and two separate duct works for filling and evacuating as the gas conveying means; however with an appropriate network of ducts and valves as is known to the trade, one can use only one blower. Similarly mixing valve 10 may be eliminated by using a blower combined with a fluidized nozzle as is known to the trade. Other gas conveying means known to the trade may also be used without departing from the intent of the invention.

Figure 3:
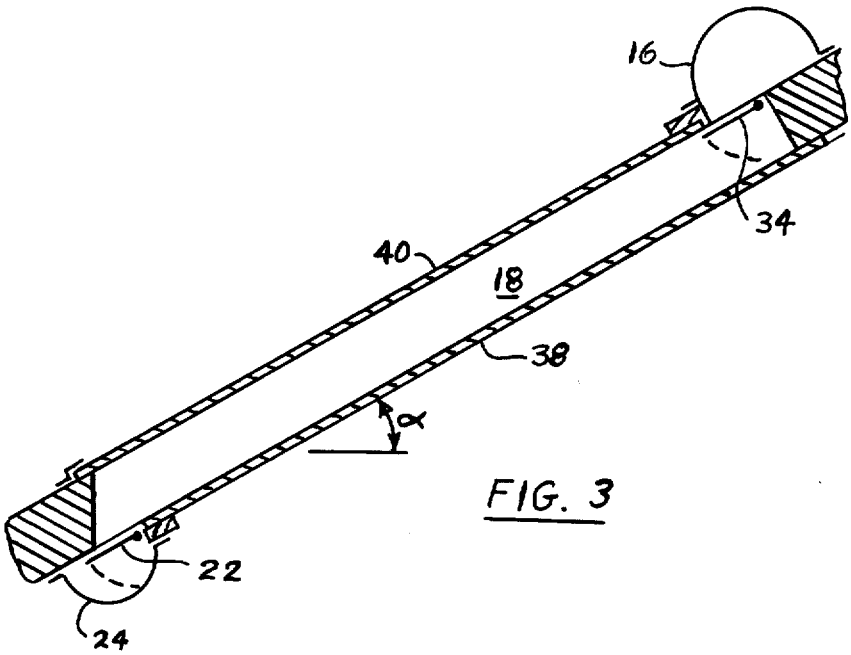
FIG. 3 is a cross-sectional view of a typical double-glazed panel.

FIG. 3 represents a cross-sectional view of a typical panel in the preferred way of the invention. Header 16 is secured over panel 18 and communicates through its bottom with the interspace in the panel defined between inner 38 and outer 40 glazing sheets. Panel 18 is operationally closed at or near its bottom end by retaining means 22. The granular material conveyed through header 16 in the filling mode settles to the bottom of it and drain into the interspace of panel 18. Panel 18 is either vertical or slanted at an angle exceeding the angle of repose of the granular material whereby the granular material flows down and fills the interspace. For expanded polystyrene beads the minimum angle would be 30° approximately. In the evacuating mode, retaining means 22 are partially opened to allow the granular material to drain at a controlled rate into a flow of conveying gas flowing through evacuation duct 24. Header 16 and evacuation duct 24 are shown as distinct from the panel and adjacent to the top and bottom respectively of the panel; however they can either be made as integral parts of the panel either as enlargements or extensions of the top and bottom respectively of the panel, or remotely positioned in relation to the panel respectively above and below and connected to the panel by conduits without departing from the intent of the invention.

Figure 4:
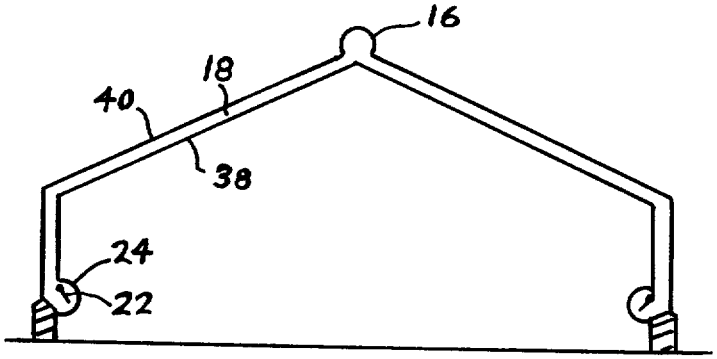
FIG. 4 and FIG. 5 are cross-sectional views of possible greenhouse arrangements.

FIG. 4 in a cross-sectional view shows how the system can be used to insulate the walls of a double-glazed greenhouse. A header 16 runs the full lenght of the apex of the greenhouse and communicates below with the interspace in panels 18 formed by the inner and outer glazing sheets 38 and 40 and regularly spaced structural members which can be the skeleton of the greenhouse. The gas conveyed granular material flowing through header 16 fills progressively all the panels thereof in the filling mode. In the evacuating mode the granular material is evacuated from the greenhouse walls by partially opening retaining means 22 and allowing the granular material to drain at a controlled rate into the conveying gas flowing through evacuating ducts 24 which runs the full lenght of the bottom of the greenhouse walls for conveyance back to the storage container.

Figure 5:
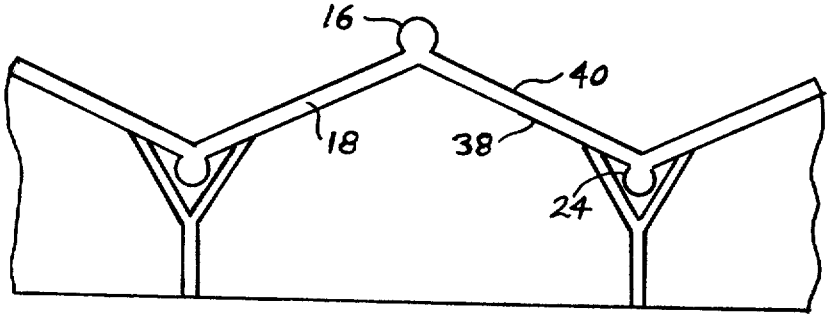

FIG. 5 in a cross-sectional view shows how greenhouses can be grouped together to reduce heat losses even more by eliminating some outside vertical walls and joining roofs together. The granular material is conveyed through headers 16 running the full lenght of the apexes and communicating with panels 18 defined by the inner and outer glazing sheets 38 and 40 cooperating with slanted structural spacer members to form the roof of the greenhouse. Panels 18 are evacuated as in FIG. 4 by conveying the granular material away through evacuation ducts 24 running the full lenght of the nadirs. In winter, snow and ice accumulating at the nadirs can be melted away by using heating wires or heating pipes running in the nadirs.

The conveying gas may be air, but in a preferred embodiment it is a diatomic gas such as carbon dioxide, which has a lower thermal conductivity than air, is safer than air with which dust explosion can be a hazard, and finally can only be beneficial to plants if leaked inside a greenhouse. The system can be opened to the atmosphere but in a preferred embodiment it is sealed to exclude outside moisture and dirt, and in the case when carbon dioxide is used, to retain the conveying gas and exclude outside air.

The granular material may be any reasonably light free flowing preferably insulating granular material that can be safely conveyed in a current of gas, is relatively clean and free of static electricity build-up. Sawdust, vermiculite, dried expanded cereals in their natural form or pyrolised and/or coated with a suitable plastic finish can be used. Expanded polystyrene in bead form is a preferred material since it is hydrophobic, mildew proof, clean and relatively inexpensive; it can be supplied stabilized against ultraviolet radiation and made static free by coating the beads with detergent, soap or an antistatic agent known to the trade.

Since the conveying gas pressures are very small, almost any light-transmitting material can be used for the inner and outer glazing, such as glass, polyethylene, polyvinyl fluoride, polyvinyl chloride or a plastic film having sealed air bubble. Plastic sheets or films should be washed with soap or detergent to make them static free.

While only certain embodiments of the invention have been illustrated and described, it is apparent that modifications, alterations and changes may be made without departing from the true scope and spirit thereof as defined in the appended claims.

The embodiments of the invention for which an exclusive property or privelege is claimed are defined as follows:

1. A double-glazed panel structure and a system for selectively filling and evacuating the panel structure with granular material comprising:

(a) a double-glazed panel structure having an interspace vertically extending at an angle exceeding the angle of repose of the granular material, an upper edge portion and a lower edge portion, and having an inlet in the upper edge portion and an outlet in the lower edge portion for the passage of the granular material in and out of the interspace respectively;

(b) a container for operatively storing the granular material;

(c) a duct-like header for the through flow of the gas conveyed granular material and the settling of at least a portion of the conveyed granular material, said header defining an inlet and an outlet end aperture in the opposite ends thereof and a bottom duct-like portion intermediate the inlet and the outlet end apertures and overlying the upper edge portion of the panel said intermediate bottom portion also having outlet means at the bottom thereof communicating with the inlet in the upper edge portion of the panel; and (d) means connected to the container and to the inlet and the outlet end apertures of the header and constructed and arranged for in the filling mode gas conveying the granular material from the container to the inlet end aperture and through the header wherein at least a portion of the granular material settles to the bottom of the header and into the interspace of the panel and for returning the conveying gas and ay unsettled or excess granular material outwardly through the outlet end aperture back to the container; and (e) an evacuating duct underlying the lower edge portion of the panel, having an inlet end aperture and an opposite outlet end aperture for the through flow of the conveying gas and also having aperture means in the top thereof communicating with the outlet in the lower edge portion of the panel; and (f) controllable retaining means located between the outlet in the lower edge portion of the panel and the aperture means in the top of the evacuation duct for selectively retaining the granular material in the panel in the filling mode and for opening in the evacuating mode whereby the granular material is allowed to drain at a controlled rate in to the evacuation duct; and (g) gas conveying means connected to the outlet end aperture of the evacuation duct and to the container whereby in the evacuating mode, upon operation thereof, air is admitted at the inlet end of the evacuation duct and flows through the evacuation duct conveying the granular material through the outlet end aperture of the evacuation duct back to the container.

2. A panel structure and a system as defined in claim 1 wherein the inlet end aperture of the evacuation duct is connected to the container whereby upon selective operation of the conveying means the conveying gas flows from the container through the evacuation duct wherein it fluidises the granular material and then conveys it to the container in a closed circuit.

3. A panel structure and a system as defined in claim 1 wherein the panel structure includes a plurality of panel sections commonly underlying the header and overlying the evacuation duct, each said section having said controllable retaining means.

4. A panel structure and a system as defined in claim 2 wherein the panel structure includes a plurality of panel sections commonly underlying the header and overlying the evacuation duct, each said section having said controllable retaining means.

5. A panel structure and a system as defined in claim 4 further comprising closure means in the upper edge of the panel sections for selectively preventing a number of panel sections from being filled in the filling mode, thereby creating partial shading.

6. A panel structure and a system as defined in claim 2 wherein the conveying gas is carbon dioxide.

7. A panel structure and a system as defined in claim 7 further comprising closure means in the upper edge portion of the panel sections for selectively preventing a number of panel sections from being filled in the filling mode, thereby creating partial shading.

8. A panel structure and a system as defined in claim 4 further comprising means for blowing gas through the filled panels for carrying the heat away.

9. A panel structure and a system as defined in claim 1 wherein the header is of a predetermined larger effective cross section than the duct used in the conveying means upstream of the header, such that the velocity of the conveying gas sufficiently decreases in the header to allow settling of the granular material to the bottom of the header and into the interspace in the panel structure.

10. A panel structure and a system as defined in claim 2 wherein the header is of a predetermined larger effective cross section than the duct used in the conveying means upstream of the header, such that the velocity of the conveying gas sufficiently decreases to allow settling of the granular material to the bottom of the header and into the interspace in the panel structure.

* * * * *